US009365982B2

(12) United States Patent
Bradley et al.

(10) Patent No.: US 9,365,982 B2
(45) Date of Patent: Jun. 14, 2016

(54) DURABLE CREPED TISSUE

(71) Applicant: Kimberly-Clark Worldwide, Inc., Neenah, WI (US)

(72) Inventors: Elizabeth Oriel Bradley, Neenah, WI (US); Christopher Lee Satori, Hortonville, WI (US); John Alexander Werner, IV, New Milford, CT (US); Kenneth John Zwick, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 14/429,659

(22) PCT Filed: Oct. 28, 2014

(86) PCT No.: PCT/US2014/062666
§ 371 (c)(1),
(2) Date: Mar. 19, 2015

(87) PCT Pub. No.: WO2015/066036
PCT Pub. Date: May 7, 2015

(65) Prior Publication Data

US 2016/0017542 A1 Jan. 21, 2016

Related U.S. Application Data

(60) Provisional application No. 61/897,965, filed on Oct. 31, 2013.

(51) Int. Cl.

| | |
|---|---|
| ***D21H 27/40*** | (2006.01) |
| ***B31D 1/04*** | (2006.01) |
| ***D21H 23/10*** | (2006.01) |
| ***D21H 11/04*** | (2006.01) |
| ***D21H 21/20*** | (2006.01) |

(52) U.S. Cl.
CPC ..... *D21H 27/40* (2013.01); *B31D 1/04* (2013.01); *D21H 11/04* (2013.01); *D21H 21/20* (2013.01); *D21H 23/10* (2013.01)

(58) Field of Classification Search
CPC ..... D21H 27/40; D21H 11/04; D21H 21/20
USPC ..... 162/111
See application file for complete search history.

(56) References Cited

U.S. PATENT DOCUMENTS

| | | | |
|---|---|---|---|
| 5,935,383 | A | 8/1999 | Sun et al. |
| 6,027,611 | A | 2/2000 | McFarland et al. |
| 6,332,952 | B1 | 12/2001 | Hsu et al. |
| 6,440,267 | B1 | 8/2002 | Rekoske et al. |
| 7,883,604 | B2 | 2/2011 | Dyer et al. |
| 8,679,295 | B2 | 3/2014 | Druecke et al. |
| 8,834,678 | B2 | 9/2014 | Druecke et al. |
| 2010/0006249 | A1 | 1/2010 | Kokko et al. |
| 2010/0155004 | A1 | 6/2010 | Wang et al. |

FOREIGN PATENT DOCUMENTS

| | | | |
|---|---|---|---|
| EP | 0 616 074 | A1 | 9/1994 |
| WO | WO 96/06223 | A1 | 2/1996 |

*Primary Examiner* — Mark Halpern
(74) *Attorney, Agent, or Firm* — Kimberly-Clark Worldwide, Inc.

(57) ABSTRACT

It has now been discovered that the ratio of the wet tensile strength to the dry tensile strength of a tissue web, and more particularly a creped tissue web, can meet or exceed satisfactory levels without the excess use of a wet strength resin. For example, by treating the tissue making furnish with less than about 3 kilograms of wet strength resin per ton of furnish, forming the tissue web, and then creping the tissue web with a creping composition comprising a non-fibrous olefin polymer and a dispersing agent, a tissue web having a CD Wet/Dry ratio greater than about 0.30 may be produced. This discovery provides the flexibility to produce a tissue product with increased wet strength while reducing the add-on of wet strength agent.

20 Claims, 1 Drawing Sheet

DURABLE CREPED TISSUE

RELATED APPLICATIONS

The present application is a national-phase entry, under 35 U.S.C. §371, of PCT Patent Application No. PCT/US14/62666, filed on Oct. 28, 2014, which claims priority to U.S. Provisional Patent Application No. 61/897,965, filed on Oct. 31, 2013, all of which are incorporated herein by reference in a manner consistent with the present application.

BACKGROUND

For tissue products such as facial and bath tissue and paper towels, strength and softness are important properties to many consumers. The strength properties of a product can be expressed in terms of wet strength and dry strength. The dry strength is important from the standpoint of manufacturing, since the product must have sufficient strength to pass through various stages in the manufacturing process where the sheet is unsupported and under tension. In the case of paper towels, for example, the dry strength must also be sufficient to enable a towel sheet to be detached from a roll of perforated sheets without tearing and to perform tasks in the dry state without shredding. The wet strength is particularly important because towels are routinely used to wipe up spills. As such, it is necessary that the towel hold up in use after it has been wetted. The amount of wet tensile strength developed using conventional alkaline curing wet strength resins, such as polyamide-epichlorohydrin (PAE) resins (i.e. Kymene® resins from Ashland Inc., Covington, Ky.) has been found in practice to be a function of the dry tensile strength of the sheet. Depending upon the furnish, the resin addition level and the water chemistry conditions, the wet tensile strength is generally limited to about 30-40 percent of the dry tensile strength of the sheet. Thus, in order to make tissue or paper products with a high level of wet tensile strength, one has to also develop a high level of dry tensile strength. Unfortunately, tissues and towels with high dry tensile strengths also exhibit high stiffness and therefore poor hand feel properties since the properties of softness (as characterized by low stiffness) and strength are inversely related. As strength is increased (both wet and dry strength), softness is decreased. Conversely, as softness is increased, the strength is decreased. A high wet/dry strength ratio is desired to provide superior durability when wet, while at the same time exhibiting low stiffness and desirable handfeel properties when dry. Hence there is a need for a means to increase the wet strength/dry strength ratio while maintaining or decreasing the stiffness of the sheet.

SUMMARY

It has now been discovered that the ratio of the wet tensile strength to the dry tensile strength of a tissue web, and more particularly a creped tissue web, can meet or exceed satisfactory levels without the excess use of a wet strength resin. For example, by treating the tissue making furnish with less than about 3 kilograms (kg) of wet strength resin per metric ton of furnish, forming the tissue web, and then creping the tissue web with a creping composition comprising a non-fibrous olefin polymer and a dispersing agent, a tissue web having a CD Wet/Dry ratio greater than about 0.3 may be produced. This discovery provides the flexibility to produce a tissue product with increased wet strength while reducing the add-on of wet strength.

Hence, in one aspect, the present invention provides a durable creped tissue product produced by the process comprising the steps of dispersing a furnish to form a fiber slurry; adding a wet strength resin to the fiber slurry in an amount less than about 3 kg per metric ton of furnish; forming a wet tissue web; partially dewatering the wet tissue web; applying a non-fibrous olefin polymer and a dispersing agent to a creping cylinder; pressing the partially dewatered tissue web to the creping cylinder; drying the tissue web; and creping the dried tissue web from the creping cylinder to produce a creped tissue web; plying two or more creped tissue webs together to form a tissue product having a Basis Weight greater than about 25 gsm and a CD Wet/Dry Ratio greater than about 0.30.

In other aspects the invention provides a durable creped tissue product comprising from about 1 to about 3 kg of a polyamide-epichlorohydrin wet strength resin per ton of furnish, the tissue web having a CD Wet/Dry Ratio greater than about 0.30, such as from about 0.30 to about 0.50.

In still other aspects, the present invention provides a creped tissue web having both satisfactory wet tensile strength and low stiffness. For example, in one aspect, the present invention provides a creped tissue web, comprising from about 1 to about 3 kg of a polyamide-epichlorohydrin wet strength resin per ton of furnish, the tissue web having a CD Wet/Dry Ratio greater than about 0.30 and a Stiffness Index less than about 20 such as from about 16 to about 20.

In still other aspects, the present invention provides a durable creped tissue product comprising at least one multi-layered creped tissue web, the web comprising a first, second and third layer, wherein the second layer comprises a cellulosic fiber furnish and from about 1 to about 3 kg of wet strength resin per ton of furnish, the tissue web having a CD Wet/Dry Ratio greater than about 0.30. In a particularly preferred embodiment the first and third layers of the multi-layered tissue web are substantially free from wet strength resin.

In yet other aspects, the present invention provides a creped tissue web comprising less than about 3 kg of a polyamide-epichlorohydrin wet strength resin per ton of furnish and an additive composition present on at least the first side of the tissue web, the additive composition comprising a non-fibrous olefin polymer and a dispersing agent, the olefin polymer comprising an alpha olefin interpolymer of ethylene or propylene and at least one comonomer, each comonomer being selected from the group consisting of octene, heptene, hexene, decene, and dodecene, and wherein the tissue web has a CD Wet/Dry Ratio greater than about 0.30, and a Stiffness Index less than about 18.0.

In still other aspects the present invention provides a method of manufacturing a creped tissue product comprising dispersing cellulosic fibers to form a first, a second and a third fiber slurry, adding a wet strength resin to the second fiber slurry in an amount less than about 3 kg per metric ton of furnish; forming a multi-layered tissue web wherein the first fiber slurry forms the first layer, the second fiber slurry forms the second layer and the third fiber slurry forms the third layer, partially dewatering the wet tissue web, applying a non-fibrous olefin polymer and a dispersing agent to a creping cylinder, pressing the partially dewatered tissue web to the creping cylinder, drying the tissue web and creping the dried tissue web from the creping cylinder.

DEFINITIONS

Figure 1:
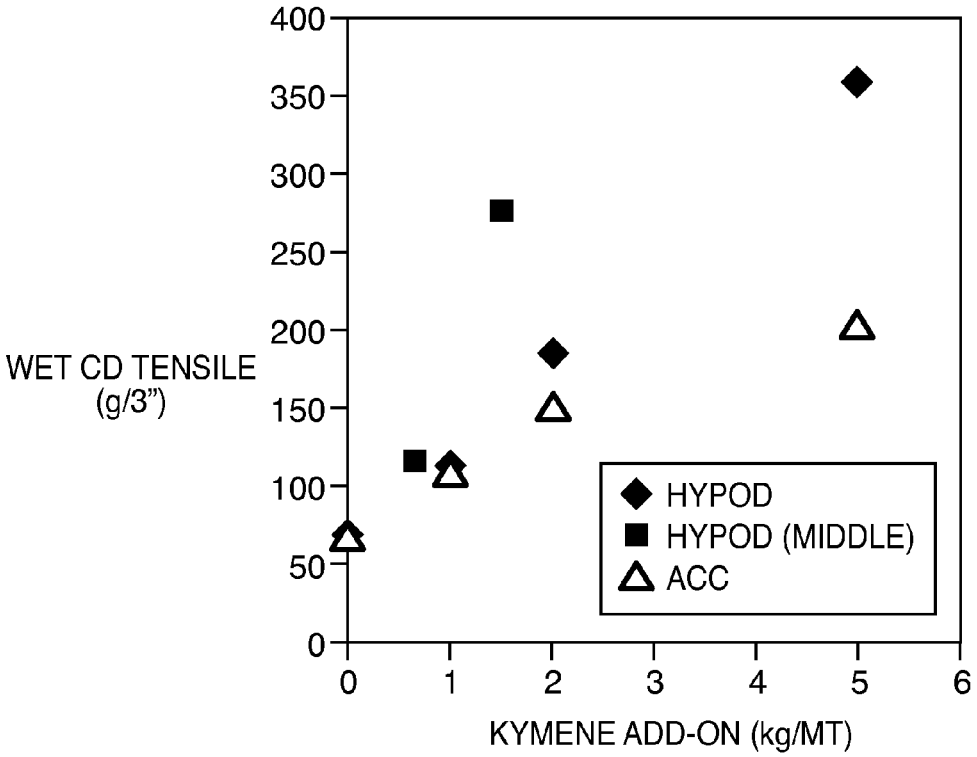
FIG. 1 illustrates the effect of wet strength add-on (x-axis) on Wet CD Tensile (y-axis)
Figure 2:
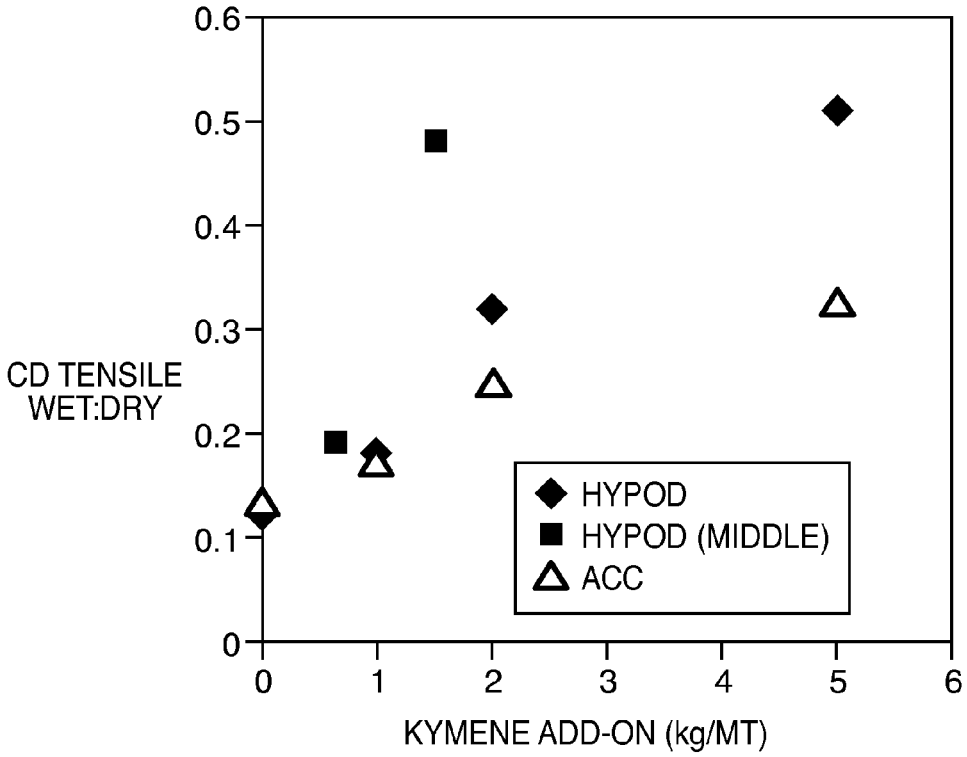
FIG. 2 illustrates the effect of wet strength add-on (x-axis) on CD Wet/Dry Ratio (y-axis).

As used herein, the term "tissue product" refers to products made from tissue webs and includes, bath tissues, facial tissues, paper towels, industrial wipers, foodservice wipers, napkins, medical pads, and other similar products.

As used herein, the terms "tissue web" and "tissue sheet" refer to a fibrous sheet material suitable for use as a tissue product.

As used herein, the term "layer" refers to a plurality of strata of fibers, chemical treatments, or the like within a ply.

As used herein, the terms "layered tissue web," "multi-layered tissue web," "multi-layered web," and "multi-layered paper sheet," generally refer to sheets of paper prepared from two or more layers of aqueous papermaking furnish which are preferably comprised of different fiber types. The layers are preferably formed from the deposition of separate streams of dilute fiber slurries, upon one or more endless foraminous screens. If the individual layers are initially formed on separate foraminous screens, the layers are subsequently combined (while wet) to form a layered composite web.

As used herein, the term "ply" refers to a discrete product element. Individual plies may be arranged in juxtaposition to each other. The term may refer to a plurality of web-like components such as in a multi-ply facial tissue, bath tissue, paper towel, wipe, or napkin.

As used herein the term "Basis Weight," refers to the bone dry basis weight of the tissue web or product measured as described in the Test Methods Section, below.

As used herein the term "CD Wet/Dry Ratio," refers to the ratio of the wet CD tensile strength to the dry CD tensile strength, measured as described in the Test Methods Section, below. While the CD Wet/Dry Ratio may vary, tissue products prepared as described herein generally have a CD Wet/Dry Ratio greater than about 0.15, more preferably greater than about 0.20 and still more preferably greater than about 0.25, such as from about 0.15 to about 0.50.

As used herein the term "Wet Strength Efficiency," refers to the CD Wet/Dry Ratio divided by the add-on amount of wet strength resin (measured in kilograms per dry metric ton of fiber) multiplied by 100 and is a measure of the amount of wet strength generated relative to dry strength normalized by the amount of wet strength added.

As used herein, the term "Wet Burst Index" refers to the quotient of the Wet Burst Strength divided by the Basis Weight (measured as grams per square meter) multiplied by 10.

$$\text{Wet Burst Index} = \frac{\text{Wet Burst Strength}}{\text{Basis Weight}} \times 10$$

Generally tissue products prepared according to the present invention have a Burst Strength greater than about 100 gf, more preferably greater than about 150 gf and still more preferably greater than about 200 gf. While Wet Burst Index may vary depending on the composition of the tissue web, as well as the basis weight of the web, webs prepared according to the present disclosure generally have a Wet Burst Index greater than 3.0, such as from about 3.0 to about 15.0, and still more preferably from about 5.0 to about 12.0.

As used herein, the terms "geometric mean tensile" and "GMT" refer to the square root of the product of the machine direction tensile strength and the cross-machine direction tensile strength, measured as described in the Test Methods section, below.

As used herein, the terms "Wet GMT Index" refers to the square root of the product of the wet machine direction tensile strength and the wet cross-machine direction tensile strength, measured as described in the Test Methods section, divided by the Basis Weight. While the Wet GMT Index may vary depending on the composition of the tissue web, as well as the basis weight of the web, webs prepared according to the present disclosure generally have a Wet GMT Index greater than about 3.0, such as from about 3.0 to about 10.0 and in particularly preferred embodiments from about 4.5 to about 10.0.

As used herein, the terms "wet geometric mean tensile energy index" and "Wet TEA Index" refer to the square root of the product of the Wet MD and CD tensile energy absorption ("Wet MD TEA" and "Wet CD TEA," typically expressed in g*cm/cm$^2$) divided by the Basis Weight (measured as grams per square meter) strength multiplied by 100.

$$\text{Wet } TEA \text{ Index} = \frac{\sqrt{\text{Wet } MD\ TEA \times \text{Wet } CD\ TEA}}{\text{Basis Weight}} \times 100$$

While the Wet TEA Index may vary depending on the composition of the tissue web, as well as the basis weight of the web, webs prepared according to the present disclosure generally have a Wet TEA Index greater than about 2.5, such as from about 2.5 to about 10.0 and still more preferably from about 5.0 to about 10.0.

As used herein, the term "Wet Durability Index" refers to the sum of the Wet CD Tensile Index, Wet Burst Index and Wet TEA Index and is an indication of the durability of the product at a given tensile strength.

$$\text{Durability Index} = \text{Wet CD Tensile Index} + \text{Wet Burst Index} + \text{Wet TEA Index}$$

While the Durability Index may vary depending on the composition of the tissue web, as well as the basis weight of the web, webs prepared according to the present disclosure generally have a Wet Durability Index value of about 10.0 or greater, such as from about 10.0 to about 35.0 and in particularly preferred embodiments from about 15.0 to about 35.0.

As used herein, the term "slope" refers to slope of the line resulting from plotting tensile versus stretch and is an output of the MTS TestWorks™ in the course of determining the tensile strength as described in the Test Methods section. Slope is reported in the units of kilograms force (kgf) per unit of sample width (inches) and is measured as the gradient of the least-squares line fitted to the load-corrected strain points falling between a specimen-generated force of 70 to 157 grams (0.687 to 1.540 N).

As used herein, the term "geometric mean slope" (GM Slope) generally refers to the square root of the product of machine direction slope and cross-machine direction slope.

As used herein, the term "Stiffness Index" refers to the quotient of the geometric mean slope (expressed in units of kgf) divided by the geometric mean tensile strength (expressed in units of g/3") multiplied by 1,000 as set forth below:

$$\text{Stiffness Index} = \frac{\sqrt{MD\ \text{Slope} \times CD\ \text{Slope}}}{GMT} \times 1{,}000$$

The Stiffness Index is expressed herein without units. While the Stiffness Index may vary depending on the composition of the tissue web, as well as the basis weight of the web, webs prepared according to the present disclosure generally have a Stiffness Index value of less than about 20, such as from about 15 to about 20 and in particularly preferred embodiments from about 16 to about 18.

As used herein the term "ton of furnish" refers to one thousand kilograms (1,000 kg) of air dried papermaking furnish having a moisture content less than about ten percent (10%).

Description

Generally, the present invention provides a creped tissue web having a CD Wet/Dry ratio that meets or exceeds satisfactory levels without the excess use of a wet strength resin. The satisfactory level of CD Wet/Dry ratio is generally greater than about 0.30, more preferably greater than about 0.35 and still more preferably greater than about 0.40, such as from about 0.0.30 to about 0.50. The satisfactory level of CD Wet/Dry ratio is surprisingly achieved by treating the tissue making furnish with less than about 5 kg of wet strength resin per metric ton of furnish, such as from about 1 to about 5 kg, and more preferably from about 1 to about 3 kg. Further, after forming the tissue web with less than about 5 kg of wet strength resin per metric ton of furnish, the tissue web may be creped. In certain embodiments the web is creped using a creping composition comprising a non-fibrous olefin polymer and a dispersing agent. There exists a surprising synergistic effect between the non-fibrous olefin polymer composition and the wet strength resin, which allows for low add-on of wet strength resin, without a deleterious effect on wet strength.

Moreover, the high levels of wet strength are generally achieved without the addition of oils, waxes, silicones, latexes, fatty alcohols, or lotions comprising one or more emollients during manufacture of the tissue web or by post-treatment. For example, tissue webs and products prepared therefrom, according to the present invention, are formed without the addition of oils, waxes, silicones, latexes, fatty alcohols, or lotions comprising one or more emollients. Similarly, it is preferred that tissue webs are not post-treated, i.e., subjected to treatment by printing, spraying, coating, or the like after formation and drying of the tissue web, with oils, waxes, silicones, latexes, fatty alcohols, or lotions comprising one or more emollients.

Further, tissues prepared according to the present disclosure are not treated with a sizing agent, such as alkyl ketene dimer (AKD) or alkenyl succinic anhydride (ASA), either during the tissue manufacturing process or after formation and drying of the tissue web. Rather, the tissue webs are prepared by adding a wet strength resin, preferably to the papermaking furnish prior to formation of the web, to enhance the wet strength properties of the finished web. Unlike conventional sizing agents, which reduce the adsorption rate of water into the sheet, wet strength resins allow the sheet to adsorb water as intended during the end use but maintain sheet integrity and strength when wetted.

Useful wet strength resins include diethylenetriamine (DETA), triethylenetetramine (TETA), tetraethyienepentamine (TEPA), epichlorhydrin resin(s), polyamide-epichlorohydrin (PAE), or any combinations thereof, or any resins to be considered in these families of resins. Particularly preferred wet strength resins are polyamide-epichlorohydrin (PAE) resins. Commonly PAE resins are formed by first reacting a polyalkylene polyamine and an aliphatic dicarboxylic acid or dicarboxylic acid derivative. A polyaminoamide made from diethylenetriamine and adipic acid or esters of dicarboxylic acid derivatives is most common. The resulting polyaminoamide is then reacted with epichlorohydrin. Useful PAE resins are sold under the tradename Kymene® (commercially available from Ashland, Inc., Covington, Ky.).

Generally the wet strength resin is added to the fiber furnish prior to formation of the tissue web. The amount of the wet strength resin can be less than about 5 kg per ton of furnish, more preferably less than about 4 kg per ton of furnish and still more preferably less than about 3 kg per ton of furnish. Generally the add-on level of wet strength resin will be from about 1 to about 5 kg per ton of furnish and more preferably from about 2 to about 4 kg per ton of furnish and still more preferably from about 2 to about 3 kg per ton of furnish.

In other embodiments the amount of wet strength resin may be expressed as the amount of wet strength present in a tissue sample on a mass basis. For example, the amount of wet strength resin in a tissue product may be measured by acid hydrolysis of the tissue sample followed by HPLC analysis to measure the concentration of adipic acid, as is known in the art. In certain embodiments the amount of wet strength resin in a tissue product is less than about 0.5 milligrams (mg) per gram (g) of tissue product, still more preferably less than about 0.4 mg/g, and in other embodiments less than about 0.2 mg/g. In a particularly preferred embodiment the amount of wet strength resin range from about 0.1 to about 0.3 mg/g, while still maintaining the desired wet strength and durability characteristics.

Although such low add on levels of wet strength are generally not considered to be suitable for achieving satisfactory wet strength, such as a CD Wet/Dry Ratio greater than about 0.30, it has now been discovered that combining low levels of wet strength with a creping additive comprising a non-fibrous olefin polymer and a dispersing agent yields tissue webs having a CD Wet/Dry Ratio greater than about 0.30 and in certain embodiments greater than about 0.35, such as from about 0.0.30 to about 0.50. The combination of wet strength resin and more particularly PAE resins, and creping additives comprising a non-fibrous olefin polymer and a dispersing agent have a synergistic effect. Accordingly, when the CD Wet/Dry Ratio and Wet Strength Efficiency are concerned, the combination of wet strength resin addition and creping additive according to the invention provides a very large synergistic effect which has not been disclosed previously. This synergistic effect is valuable, since it makes it possible to achieve a higher wet strength level without the excessive wet strength resin, which reduces costs and maintains or improves tissue properties which deteriorate when wet strength resins are added to the web in high amounts.

TABLE 1

| Creping Additive | Wet Strength (kg/MT) | Wet Strength Addition Layer | CD Wet/Dry Ratio | Delta CD Wet/Dry Ratio (%) |
|---|---|---|---|---|
| Non-Fibrous Olefin Polymer | 0 | None | 0.12 | — |
| Non-Fibrous Olefin Polymer | 2 | All | 0.325 | 171% |

TABLE 1-continued

| Creping Additive | Wet Strength (kg/MT) | Wet Strength Addition Layer | CD Wet/Dry Ratio | Delta CD Wet/Dry Ratio (%) |
|---|---|---|---|---|
| Non-Fibrous Olefin Polymer | 1.5 | Middle | 0.485 | 304% |
| Conventional | 0 | None | 0.132 | — |
| Conventional | 2 | All | 0.249 | 89% |

Even more surprising is that the greatest benefit, measured as the relative increase in CD Wet/Dry Ratio, may be achieved by selectively incorporating wet strength into a the middle layer of a multi-layered web in relatively small amounts such as from about 1 to about 3 kg per ton of furnish. At the same time stiffness of the web may be improved without a degradation of other attributes.

By reducing the wet strength and creping the web using creping additive comprising a non-fibrous olefin polymer the present invention provides a web that has surprising characteristics. For example, tissue webs of the present invention may provide benefits over currently available webs in the areas of, for example, stiffness. In certain embodiments webs comprising less than about 3 kg of wet strength resin per ton of furnish, have a Stiffness Index of less than about 20, such as from about 15 to about 20, and more preferably from about 16 to about 18. In still other embodiments the tissue products are not only soft, such as having a Stiffness Index less than about 20 they are also extremely durable having a Durability Index 10.0 or greater, such as from about 10.0 to about 25.0. Further, at the foregoing Stiffness and Durability levels the tissue products generally have a CD Wet/Dry Ratio greater than about 0.3, such as from about 0.3 to about 0.5.

The tissue products of the present invention are preferably formed from cellulosic fibers and more preferably from wood

TABLE 2

| Creping Additive | Wet Strength (kg/MT) | Wet Strength Addition Layer | Delta CD Wet/Dry Ratio (%) | Stiffness Index | Delta Stiffness Index | Durability Index | Delta Durability Index |
|---|---|---|---|---|---|---|---|
| Non-Fibrous Olefin Polymer | — | — | | 19.87 | — | 6.92 | — |
| Non-Fibrous Olefin Polymer | 2 | All | 171% | 17.9 | −10% | 17.82 | 158% |
| Non-Fibrous Olefin Polymer | 1.5 | Middle | 304% | 16.7 | −16% | 21.96 | 217% |

Accordingly, in one preferred embodiment tissue products comprise at least one multi-layered tissue web. Preferably the web comprises three layers where wet strength resin is selectively disposed in the middle layer. While in one embodiment it is preferred that the tissue web comprise a three-layered tissue having wet strength selectively incorporated into the middle layer, it should be understood that tissue products made from the foregoing multi-layered web can include any number of plies and the plies may be made from various combinations of single and multi-layered tissue webs. Further, tissue webs prepared according to the present invention may be incorporated into tissue products that may be either single or multi-ply, where one or more of the plies may be formed by a multi-layered tissue web having wet strength selectively incorporated in one of its layers.

The amount of wet strength present within any given layer of the multi-layered tissue web may generally vary depending on the desired properties of the tissue product. Generally the amount of wet strength added to any single layer, or combination of layers, should be enough such that the total add-on of wet strength is less than about 5 kg per ton of furnish used to form the web, more preferably less than about 3 kg per ton of furnish, such as from about 1 to about 3 kg per ton of furnish.

The properties of the resulting tissue web may also be varied by selecting particular layer(s) for incorporation of wet strength. It has now been discovered that the greatest increase in CD Wet/Dry Ratio without adverse effects of stiffness or other sheet properties is achieved by incorporating wet strength into the middle layer of a three layered web and more specifically to a middle layer consisting essentially of softwood pulp fibers. In such embodiments it is preferred that the two outer layers are substantially free of wet strength. It should be understood that, when referring to a layer that is substantially free of wet strength, some de minimis amount of wet strength may be present. However, such small amounts often arise from wet strength treated furnish used in an adjacent layer, and do not typically substantially affect the wet strength or other physical characteristics of the tissue web.

fibers and still more preferably wood pulp fibers such as, but not limited to, northern softwood, southern softwood, redwood, red cedar, hemlock, pine (e.g., southern pines), spruce (e.g., black spruce), combinations thereof, and the like. Additionally, if desired, secondary fibers obtained from recycled materials may be used, such as fiber pulp from sources such as, for example, newsprint, reclaimed paperboard, and office waste.

As indicated above, in a particularly preferred embodiment, wet strength resin is blended with wood fibers and incorporated into one or more layers of a multi-layered tissue web. For instance, one embodiment of the present invention includes the formation of a single ply tissue product having three layers where the wet strength resin is selectively incorporated in the center layer. For example, in one embodiment, the inner layer comprises a blend of softwood fibers and wet strength resin, such that the total weight of softwood fibers in the layer ranges from about 20 to about 40 percent and the outer layers comprise hardwood fibers and represents from about 60 to about 80 percent by weight of the web. Other arrangements and combinations of fibers are contemplated, so long as the tissue product comprises at least one multi-layered web, wherein at least one layer of the multi-layered web comprising a wet strength resin and cellulosic fibers.

Fibrous tissue webs can generally be formed according to a variety of papermaking processes known in the art. For example, wet-pressed tissue webs may be prepared using methods known in the art and commonly referred to as couch forming, wherein two wet web layers are independently formed and thereafter combined into a unitary web. To form the first web layer, fibers are prepared in a manner well known in the papermaking arts and delivered to the first stock chest, in which the fiber is kept in an aqueous suspension. A stock pump supplies the required amount of suspension to the suction side of the fan pump. Additional dilution water also is mixed with the fiber suspension.

To form the second web layer, fibers are prepared in a manner we known in the papermaking arts and delivered to the second stock chest, in which the fiber is kept in an aqueous suspension. A stock pump supplies the required amount of suspension to the suction side of the fan pump. Additional dilution water is also mixed with the fiber suspension. The entire mixture is then pressurized and delivered to a headbox. The aqueous suspension leaves the headbox and is deposited onto an endless papermaking fabric over the suction box. The suction box is under vacuum which draws water out of the suspension, thus forming the second wet web. In this example, the stock issuing from the headbox is referred to as the "dryer side" layer as that layer will be in eventual contact with the dryer surface. In some embodiments, it may be desired for a layer containing the synthetic and pulp fiber blend to be formed as the "dryer side" layer.

After initial formation of the first and second wet web layers, the two web layers are brought together in contacting relationship (couched) while at a consistency of from about 10 to about 30 percent. Whatever consistency is selected, it is typically desired that the consistencies of the two wet webs be substantially the same. Couching is achieved by bringing the first wet web layer into contact with the second wet web layer at roll.

After the consolidated web has been transferred to the felt at the vacuum box, dewatering, drying and creping of the consolidated web is achieved in the conventional manner. More specifically, the couched web is further dewatered and transferred to a dryer (e.g., Yankee dryer) using a pressure roll, which serves to express water from the web, which is absorbed by the felt, and causes the web to adhere to the surface of the dryer.

The wet web is applied to the surface of the dryer by a press roll with an application force of, in one embodiment, about 200 pounds per square inch (psi). Following the pressing or dewatering step, the consistency of the web is typically at or above about 30 percent. Sufficient Yankee dryer steam power and hood drying capability are applied to this web to reach a final consistency of about 95 percent or greater, and particularly 97 percent or greater. The sheet or web temperature immediately preceding the creping blade, as measured, for example, by an infrared temperature sensor, is typically about 250° F. or higher. Besides using a Yankee dryer, it should also be understood that other drying methods, such as microwave or infrared heating methods, may be used in the present invention, either alone or in conjunction with a Yankee dryer.

At the Yankee dryer, the creping chemicals are continuously applied on top of the existing adhesive in the form of an aqueous solution. The solution is applied by any convenient means, such as using a spray boom that evenly sprays the surface of the dryer with the creping adhesive solution. The point of application on the surface of the dryer is immediately following the creping doctor blade, permitting sufficient time for the spreading and drying of the film of fresh adhesive.

The creping composition may comprise a non-fibrous olefin polymer, as disclosed in U.S. Pat. No. 7,883,604, the contents of which are hereby incorporated by reference in a manner consistent with the present disclosure, which may be applied to the surface of the Yankee dryer as a water insoluble dispersion that modifies the surface of the tissue web with a thin, discontinuous polyolefin film. In particularly preferred embodiments the creping composition may comprise a film-forming composition and an olefin polymer comprising an interpolymer of ethylene and at least one comonomer comprising an alkene, such as 1-octene. The creping composition may also contain a dispersing agent, such as a carboxylic acid. Examples of particular dispersing agents, for instance, include fatty acids, such as oleic acid or stearic acid.

In one particular embodiment, the creping composition may contain an ethylene and octene copolymer in combination with an ethylene-acrylic acid copolymer. The ethylene-acrylic acid copolymer is not only a thermoplastic resin, but may also serve as a dispersing agent. The ethylene and octene copolymer may be present in combination with the ethylene-acrylic acid copolymer in a weight ratio of from about 1:10 to about 10:1, such as from about 2:3 to about 3:2.

The olefin polymer composition may exhibit a crystallinity of less than about 50 percent, such as less than about 20 percent. The olefin polymer may also have a melt index of less than about 1000 g/10 min, such as less than about 700 g/10 min. The olefin polymer may also have a relatively small particle size, such as from about 0.1 micron to about 5 microns when contained in an aqueous dispersion.

In an alternative embodiment, the creping composition may contain an ethylene-acrylic acid copolymer. The ethylene-acrylic acid copolymer may be present in the creping composition in combination with a dispersing agent.

The basis weight of tissue webs made in accordance with the present disclosure can vary depending upon the final product. For example, the process may be used to produce bath tissues facial tissues, paper towels, industrial wipers, and the like. In general, the basis weight of the tissue products may vary from about 10 to about 110 grams per square meter (gsm), more preferably from about 15 to about 60 gsm and still more preferably from about 18 to about 35 gsm. In multi-ply products, the basis weight of each tissue web present in the product can also vary. In general, the total basis weight of a multi-ply product will generally be the same as indicated above, such as from about 10 to about 110 gsm, more preferably from about 25 to about 40 gsm and still more preferably from about 28 to about 34 gsm.

The geometric mean dry tensile strength of the creped webs of this invention are generally greater than about 500 g/3", such as from about 500 to about 1200 g/3", more specifically about 700 to about 1100 g/3", and still more specifically from about 800 to about 1000 g/3". The dry CD tensile strength of the creped webs of this invention are generally greater than about 500 g/3", such as from about 500 to about 800 g/3", more specifically from about 550 to about 750 g/3", and still more specifically about 600 to about 700 g/3". The wet CD tensile strength of the creped webs of this invention are generally greater than about 100 g/3", such as from about 100 to about 400 g/3" and more specifically from about 150 to about 375 g/3". At the foregoing dry and wet CD tensile strengths the tissue webs and products of the present invention generally have a CD Wet/Dry Ratio greater than about 0.30, such as from about 0.30 to about 0.50.

Test Methods

Basis Weight

The basis weight was measured as bone dry basis weight. Basis weight of the tissue sheet specimens may be determined using the TAPPI T410 procedure or a modified equivalent such as: Tissue samples are conditioned at 23±1° C. and 50±2 percent relative humidity for a minimum of 4 hours. After conditioning, a stack of 16 3-inch by 3-inch samples are cut using a die press and associated die. This represents a tissue sheet sample area of 144 $in^2$ or 929 $cm^2$. Examples of suitable die presses are TMI DGD die press manufactured by Testing Machines, Inc., Islandia, N.Y., or a Swing Beam testing machine manufactured by USM Corporation, Wilmington, Mass. Die size tolerances are ±0.008 inches in both directions. The specimen stack is then weighed to the nearest 0.001 gram using an analytical balance. The basis weight in grams per square meter (gsm) is calculated using the following equation: Basis weight=stack weight in grams/0.0929.

Tensile

Samples for tensile strength testing are prepared by cutting a 3 inches (76.2 mm) by 5 inches (127 mm) long strip in either the machine direction (MD) or cross-machine direction (CD) orientation using a JDC Precision Sample Cutter (Thwing-Albert Instrument Company, Philadelphia, Pa., Model No. JDC 3-10, Ser. No. 37333). The instrument used for measuring tensile strengths is an MTS Systems Sintech 11S, Serial No. 6233. The data acquisition software is MTS TestWorks™ for Windows Ver. 4 (MTS Systems Corp., Research Triangle Park, N.C.). The load cell is selected from either a 50 Newton or 100 Newton maximum, depending on the strength of the sample being tested, such that the majority of peak load values fall between 10 and 90 percent of the load cell's full scale value. The gauge length between jaws is 4±0.04 inches. The jaws are operated using pneumatic-action and are rubber coated. The minimum grip face width is 3 inches (76.2 mm), and the approximate height of a jaw is 0.5 inches (12.7 mm). The crosshead speed is 10±0.4 inches/min (254±1 mm/min), and the break sensitivity is set at 65 percent. The sample is placed in the jaws of the instrument, centered both vertically and horizontally. The test is then started and ends when the specimen breaks. The peak load is recorded as either the "MD tensile strength" or the "CD tensile strength" of the specimen depending on the sample being tested. At least six (6) representative specimens are tested for each product, taken "as is," and the arithmetic average of all individual specimen tests is either the MD or CD tensile strength for the product.

Wet tensile strength measurements are measured in the same manner, but after the center portion of the previously conditioned sample strip has been saturated with distilled water immediately prior to loading the specimen into the tensile test equipment. More specifically, prior to performing a wet CD tensile test, the sample must be aged to ensure the wet strength resin has cured. Two types of aging were practiced: natural and artificial. Natural aging was used for older samples that had already aged. Artificial aging was used for samples that were to be tested immediately after or within days of manufacture. For natural aging, the samples were held at 73° F., 50 percent relative humidity for a period of 12 days prior to testing. Following this natural aging step, the strips are then wetted individually and tested. For artificially aged samples, the 3-inch wide sample strips were heated for 4 minutes at 105±2° C. Following this artificial aging step, the strips are then wetted individually and tested. Sample wetting is performed by first laying a single test strip onto a piece of blotter paper (Fiber Mark, Reliance Basis 120). A pad is then used to wet the sample strip prior to testing. The pad is a green, Scotch-Brite brand (3M) general purpose commercial scrubbing pad. To prepare the pad for testing, a full-size pad is cut approximately 2.5 inches long by 4 inches wide. A piece of masking tape is wrapped around one of the 4-inch long edges. The taped side then becomes the "top" edge of the wetting pad. To wet a tensile strip, the tester holds the top edge of the pad and dips the bottom edge in approximately 0.25 inches of distilled water located in a wetting pan. After the end of the pad has been saturated with water, the pad is then taken from the wetting pan and the excess water is removed from the pad by lightly tapping the wet edge three times across a wire mesh screen. The wet edge of the pad is then gently placed across the sample, parallel to the width of the sample, in the approximate center of the sample strip. The pad is held in place for approximately one second and then removed and placed back into the wetting pan. The wet sample is then immediately inserted into the tensile grips so the wetted area is approximately centered between the upper and lower grips. The test strip should be centered both horizontally and vertically between the grips. (It should be noted that if any of the wetted portion comes into contact with the grip faces, the specimen must be discarded and the jaws dried off before resuming testing.) The tensile test is then performed and the peak load recorded as the CD wet tensile strength of this specimen. As with the dry CD tensile test, the characterization of a product is determined by the average of at least six, but in the case of the examples disclosed, twenty representative sample measurements.

Wet Burst Strength

Wet Burst Strength is measured using an EJA Burst Tester (series #50360, commercially available from Thwing-Albert Instrument Company, Philadelphia, Pa.). The test procedure is according to TAPPI T570 pm-00 except the test speed. The test specimen is clamped between two concentric rings whose inner diameter defines the circular area under test. A penetration assembly the top of which is a smooth, spherical steel ball is arranged perpendicular to and centered under the rings holding the test specimen. The penetration assembly is raised at 6 inches per minute such that the steel ball contacts and eventually penetrates the test specimen to the point of specimen rupture. The maximum force applied by the penetration assembly at the instant of specimen rupture is reported as the burst strength in grams force (gf) of the specimen.

The penetration assembly consists of a spherical penetration member which is a stainless steel ball with a diameter of 0.625±0.002 in (15.88±0.05 mm) finished spherical to 0.00004 in (0.001 mm). The spherical penetration member is permanently affixed to the end of a 0.375±0.010 in (9.525±0.254 mm) solid steel rod. A 2000 gram load cell is used and 50 percent of the load range i.e. 0-1000 g is selected. The distance of travel of the probe is such that the upper most surface of the spherical ball reaches a distance of 1.375 in (34.9 mm) above the plane of the sample clamped in the test. A means to secure the test specimen for testing consisting of upper and lower concentric rings of approximately 0.25 in (6.4 mm) thick aluminum between which the sample is firmly held by pneumatic clamps operated under a filtered air source at 60 psi. The clamping rings are 3.50±0.01 in (88.9±0.3 mm) in internal diameter and approximately 6.5 in (165 mm) in outside diameter. The clamping surfaces of the clamping rings are coated with a commercial grade of neoprene approximately 0.0625 in (1.6 mm) thick having a Shore hardness of 70-85 (A scale). The neoprene needs not cover the entire surface of the clamping ring but is coincident with the inner diameter, thus having an inner diameter of 3.50±0.01 in (88.9±0.3 mm) and is 0.5 in (12.7 mm) wide, thus having an external diameter of 4.5±0.01 in (114±0.3 mm). For each test a total of 3 sheets of product are combined.

The sheets are stacked on top of one another in a manner such that the machine direction of the sheets is aligned. Where samples comprise multiple plies, the plies are not separated for testing. In each instance the test sample comprises 3 sheets of product. For example, if the product is a 2-ply tissue product, 3 sheets of product, totaling 6 plies are tested. If the product is a single ply tissue product, then 3 sheets of product totaling 3 plies are tested.

Samples are conditioned under TAPPI conditions and cut into 127×127 mm±5 mm squares. Samples are then wetted for testing with 0.5 mL of deionized water dispensed with an automated pipette. The wet sample is tested immediately after insulting.

The peak load (gf) and energy to peak (g-cm) are recorded and the process repeated for all remaining specimens. A minimum of five specimens are tested per sample and the peak load average of five tests is reported.

EXAMPLES

Samples were made using a conventional wet pressed tissue-making process on a pilot scale tissue machine. Initially, northern softwood kraft (NSWK) pulp was dispersed in a pulper for 30 minutes at about 4 percent consistency at about 100° F. The NSWK pulp was then transferred to a dump chest and subsequently diluted with water to approximately 2 percent consistency. Softwood fibers were then pumped to a machine chest. In certain instances wet strength resin (Kymene™ 920A, Ashland, Inc., Covington, Ky.) was added to the NSWK pulp as it was metered from the machine chest to the tissue machine. The amount of wet strength added to the NSWK furnish varied depending on the sample (see Table 3 for details).

Generally the softwood fibers were added to the middle layer in the 3-layer tissue structure. The NSWK content contributed approximately 25 to 35 percent of the final sheet weight. The specific layer splits (dryer layer/middle layer/felt layer) are as set forth in Table 3.

Eucalyptus hardwood kraft (EHWK) pulp was dispersed in a pulper for 30 minutes at about 4 percent consistency at about 100° F. The EHWK pulp was then transferred to a dump chest and diluted to about 2 percent consistency. The EHWK pulp was then pumped to a machine chest. In certain instances wet strength resin (Kymene™ 920A, Ashland, Inc., Covington, Ky.) was added to the EHWK pulp as it was metered from the machine chest to the tissue machine. The amount of wet strength added to the EHWK furnish varied depending on the sample (see Table 3 for details).

Generally the EHWK fibers were added to the dryer and felt layers of the 3-layer sheet structure and contributed approximately 65 to 75 percent of the final sheet weight. The specific layer splits (dryer layer/middle layer/felt layer) are as set forth in Table 3.

The pulp fibers from the machine chests were pumped to the headbox at a consistency of about 0.1%. Pulp fibers from each machine chest were sent through separate manifolds in the headbox to create a 3-layered tissue structure. The fibers were deposited onto a felt using a Crescent Former.

The wet sheet, about 10-20 percent consistency, was adhered to a Yankee dryer via a pressure roll nip. The consistency of the wet sheet after the pressure roll nip (post-pressure roll consistency or PPRC) was approximately 40 percent. The wet sheet is adhered to the Yankee dryer due to the additive composition that is applied to the dryer surface. A spray boom situated underneath the Yankee dryer sprayed the creping/additive composition, described in the present disclosure, onto the dryer surface at addition levels of about 150 mg/m$^2$ for HYPOD™ 8510 (non-fibrous polyolefin) and 10 mg/m$^2$ of a conventional creping composition comprising 71% Crepetrol A9915 and 29% Rezosol 6601 (both available from Ashland, Inc., Covington, Ky.) hereinafter referred to as "ACC".

Creping compositions were prepared by dissolution of the solid polymers into water followed by stirring until the solution was homogeneous. Individual polymers were diluted depending on the desired spray coverage on the Yankee dryer. The sheet was dried to about 98 to 99 percent consistency as it traveled on the Yankee dryer and to the creping blade. The Yankee dryer was heated with 105 psi of steam pressure and the Yankee hood was set to a supply temperature of 650 to 750° F. to dry the sheet to a target sheet temperature of 250° F. before the creping blade. The creping blade, a 75-Proto-HY03 Durablade® (BTG, Eclépens, Switzerland) with a 15 degree grind angle, was loaded at a pressure of 60 psi. The creping blade subsequently scraped the tissue sheet off of the Yankee dryer. The creped tissue basesheet was then wound onto a core into soft rolls for converting.

To produce the 2-ply facial tissue products two soft rolls of the creped tissue were then rewound, calendered between two steel rolls to a 2-ply caliper of approximately 200 microns, and plied together so that both creped sides were on the outside of the 2-ply structure. Mechanical crimping on the edges of the structure held the plies together. The plied sheet was then slit on the edges to a standard width of approximately 8.5 inches and folded, and cut to facial tissue length. Tissue samples were conditioned and tested. The results of the testing are summarized in the tables, below.

TABLE 4

| Sample | BW (gsm) | Dry CD Tensile (g/3") | Dry MD Tensile (g/3") | Dry GMT (g/3") | GM Slope (kgf) | Stiffness Index |
|---|---|---|---|---|---|---|
| 1 | 29.3 | 595 | 1411 | 916 | 18.2 | 19.9 |
| 2 | 29.3 | 627 | 1468 | 960 | 18.0 | 18.8 |
| 3 | 29.3 | 574 | 1289 | 860 | 15.4 | 17.9 |
| 4 | 30.0 | 703 | 1583 | 1055 | 18.0 | 17.0 |
| 5 | 30.7 | 611 | 1351 | 909 | 16.2 | 17.8 |
| 6 | 30.1 | 578 | 1267 | 855 | 14.3 | 16.7 |
| 7 | 28.5 | 553 | 1328 | 857 | 13.3 | 15.5 |
| 8 | 28.7 | 644 | 1467 | 972 | 15.3 | 15.7 |
| 9 | 28.4 | 611 | 1407 | 927 | 13.6 | 14.7 |
| 10 | 28.7 | 627 | 1484 | 965 | 12.1 | 12.6 |

TABLE 5

| Sample | Wet CD Tensile (g/3") | Wet CD TEA (gf * cm/cm$^2$) | Wet MD Tensile (g/3") | Wet GMT (g/3") | Wet GM TEA (gf * cm/cm$^2$) | Wet Burst (gf) |
|---|---|---|---|---|---|---|
| 1 | 71.4 | 0.433 | 102.6 | 85.6 | 0.513 | 80.4 |
| 2 | 114.1 | 0.577 | 225.0 | 160.2 | 0.845 | 108.7 |
| 3 | 187.0 | 1.069 | 278.7 | 228.3 | 1.402 | 194.8 |

TABLE 3

| Sample | Wet Strength Resin (kg/MT) | Wet Strength Layer | NSWK (wt %) | EHWK (wt %) | Layer Split Felt/Middle/Dryer (wt %) | Creping Composition |
|---|---|---|---|---|---|---|
| 1 | 0 | — | 32% | 68% | 44/32/24 | HYPOD ™ 8510 |
| 2 | 1 | All | 32% | 68% | 44/32/24 | HYPOD ™ 8510 |
| 3 | 2 | All | 30% | 70% | 44/30/26 | HYPOD ™ 8510 |
| 4 | 5 | All | 30% | 70% | 44/30/26 | HYPOD ™ 8510 |
| 5 | 0.64 | Middle | 32% | 68% | 44/32/24 | HYPOD ™ 8510 |
| 6 | 1.5 | Middle | 30% | 70% | 44/30/26 | HYPOD ™ 8510 |
| 7 | 0 | — | 34% | 66% | 43/34/23 | ACC |
| 8 | 1 | All | 30% | 70% | 44/30/26 | ACC |
| 9 | 2 | All | 30% | 70% | 44/30/26 | ACC |
| 10 | 5 | All | 30% | 70% | 44/30/26 | ACC |

TABLE 5-continued

| Sample | Wet CD Tensile (g/3") | Wet CD TEA (gf * cm/cm$^2$) | Wet MD Tensile (g/3") | Wet GMT (g/3") | Wet GM TEA (gf * cm/cm$^2$) | Wet Burst (gf) |
|---|---|---|---|---|---|---|
| 4 | 361.9 | 2.165 | 414.1 | 387.1 | 2.611 | 346.8 |
| 5 | 117.3 | 0.622 | 157.2 | 135.8 | 0.749 | 96.7 |
| 6 | 280.0 | 1.686 | 314.1 | 296.6 | 1.760 | 203.7 |
| 7 | 73.0 | 0.312 | 113.4 | 91.0 | 0.480 | 102.4 |
| 8 | 110.9 | 0.418 | 201.1 | 149.3 | 0.697 | 104.1 |
| 9 | 152.3 | 0.614 | 331.6 | 224.7 | 1.099 | 160.5 |
| 10 | 204.9 | 0.984 | 488.2 | 316.3 | 1.840 | 269.9 |

TABLE 6

| Sample | CD Tensile Wet/Dry | Wet GMT Index | Wet TEA Index | GMT Wet/Dry | Wet Durability Index | Wet Burst Index | Durability Index |
|---|---|---|---|---|---|---|---|
| 1 | 0.120 | 2.92 | 1.75 | 0.09 | 4.18 | 2.74 | 6.92 |
| 2 | 0.182 | 5.47 | 2.88 | 0.17 | 6.77 | 3.71 | 10.48 |
| 3 | 0.325 | 7.79 | 4.79 | 0.27 | 11.17 | 6.65 | 17.82 |
| 4 | 0.514 | 12.92 | 8.72 | 0.37 | 20.80 | 11.58 | 32.37 |
| 5 | 0.192 | 4.42 | 2.44 | 0.15 | 6.26 | 3.15 | 9.41 |
| 6 | 0.485 | 9.87 | 5.86 | 0.35 | 15.18 | 6.78 | 21.96 |
| 7 | 0.132 | 3.20 | 1.69 | 0.11 | 4.25 | 3.60 | 7.85 |
| 8 | 0.172 | 5.21 | 2.43 | 0.15 | 6.30 | 3.63 | 9.92 |
| 9 | 0.249 | 7.91 | 3.87 | 0.24 | 9.23 | 5.65 | 14.88 |
| 10 | 0.327 | 11.01 | 6.41 | 0.33 | 13.54 | 9.40 | 22.95 |

What we claim is:

1. A durable creped tissue product produced by the process comprising the steps of:

a. dispersing a furnish to form a fiber slurry;

b. adding a wet strength resin to the fiber slurry in an amount less than about 3.0 kg per metric ton of furnish;

c. forming a wet tissue web;

d. partially dewatering the wet tissue web;

e. applying a non-fibrous olefin polymer and a dispersing agent to a creping cylinder;

f. pressing the partially dewatered tissue web to the creping cylinder;

g. drying the tissue web;

h. creping the dried tissue web from the creping cylinder to produce a creped tissue web; and i. plying two or more creped tissue webs together to form a tissue product having a Basis Weight greater than about 25 gsm and a CD Wet/Dry Ratio greater than about 0.30.

2. The durable creped tissue web of claim 1 wherein the tissue product has a Basis Weight from about 25 to about 35 gsm and a Stiffness Index less than about 20.

3. The durable creped tissue web of claim 1 wherein the tissue product has a Wet CD Tensile from about 150 to about 400 g/3".

4. The durable creped tissue web of claim 1 wherein the tissue product has a Wet Burst Index from about 5.0 to about 12.0.

5. The durable creped tissue web of claim 1 wherein the tissue product has a Wet Durability Index from about 15 to about 35.

6. The durable creped tissue web of claim 1 wherein the tissue product has a CD Wet/Dry Ratio from about 0.30 to about 0.50.

7. The durable creped tissue web of claim 1 wherein the tissue product has been manufactured without the addition of oils, waxes, silicones, latexes, fatty alcohols, lotions comprising one or more emollients, alkyl ketene dimer (AKD) or alkenyl succinic anhydride (ASA).

8. The durable creped tissue web of claim 1 wherein the creping composition comprises an ethylene and octene copolymer in combination with an ethylene-acrylic acid copolymer.

9. The durable creped tissue web of claim 1 wherein the wet strength resin is selected from the group consisting of diethylenetriamine (DETA), triethylenetetramine (TETA), tetraethylene-pentamine (TEPA), epichlorhydrin resin(s), and polyamide-epichlorohydrin (PAE).

10. A durable creped tissue product comprising at least one multi-layered creped tissue web comprising a first, a second, and a third layer, and a wet strength resin selectively incorporated in the second layer, the tissue product having a Basis Weight greater than about 25 gsm, a CD Wet/Dry Ratio greater than about 0.30 and Stiffness Index less than about 20.

11. The durable creped tissue web of claim 10 wherein the tissue product has a Wet CD Tensile from about 150 to about 400 g/3".

12. The durable creped tissue web of claim 10 wherein the tissue product has a Wet Burst Index from about 5.0 to about 12.0.

13. The durable creped tissue web of claim 10 wherein the tissue product has a Wet Durability Index from about 15 to about 35.

14. The durable creped tissue web of claim 10 wherein the wet strength resin is selected from the group consisting of diethylenetriamine (DETA), triethylenetetramine (TETA), tetraethylene-pentamine (TEPA), epichlorhydrin resin(s), and polyamide-epichlorohydrin (PAE).

15. A durable creped tissue product comprising from about 0.05 to about 0.2 mg of a polyamide-epichlorohydrin wet strength resin per gram of tissue and an additive composition present on at least the first side of the tissue web, the additive composition comprising a non-fibrous olefin polymer and a dispersing agent, the olefin polymer comprising an alpha olefin interpolymer of ethylene or propylene and at least one comonomer, each comonomer being selected from the group consisting of octene, heptene, hexene, decene, and dodecene, and wherein the tissue product has a CD Wet/Dry Ratio greater than about 0.30.

16. The durable creped tissue web of claim 15 wherein the tissue product has a Basis Weight from about 25 to about 35 gsm and a Stiffness Index less than about 20.

17. The durable creped tissue web of claim 15 wherein the tissue product has a Wet CD Tensile from about 150 to about 400 g/3".

18. The durable creped tissue web of claim 15 wherein the tissue product has a Wet CD Tensile from about 150 to about 400 g/3".

19. The durable creped tissue web of claim 15 wherein the tissue product has a Wet Durability Index from about 15 to about 35.

20. The durable creped tissue web of claim 15 wherein the wet strength resin is selected from the group consisting of diethylenetriamine (DETA), triethylenetetramine (TETA), tetraethylene-pentamine (TEPA), epichlorhydrin resin(s), and polyamide-epichlorohydrin (PAE).

* * * * *